United States Patent [19]

Yanagawa et al.

[11] Patent Number: 4,615,607

[45] Date of Patent: Oct. 7, 1986

[54] DUAL-COLOR COPIER

[75] Inventors: Nobuyuki Yanagawa, Chigasaki; Tadao Koike, Tokyo; Toyoji Ishikawa, Kawasaki; Katsuo Sakai; Hideya Furuta, both of Yokohama, all of Japan

[73] Assignee: Ricoh Company, Ltd., Japan

[21] Appl. No.: 612,461

[22] Filed: May 21, 1984

[30] Foreign Application Priority Data

May 20, 1983 [JP] Japan ..... 58-87511

[51] Int. Cl.[4] ..... G03G 15/00

[52] U.S. Cl. ..... 355/3 R; 355/4

[58] Field of Search ..... 355/4, 3 R, 7; 346/157; 118/645; 430/42, 44, 54

[56] References Cited

U.S. PATENT DOCUMENTS

| | | | |
|---|---|---|---|
| 2,986,466 | 5/1961 | Kaprelian | 355/4 |
| 4,189,224 | 2/1980 | Sakai | 355/4 |
| 4,349,268 | 9/1982 | Hirata | 355/4 |

FOREIGN PATENT DOCUMENTS

| | | | |
|---|---|---|---|
| 53-13430 | 2/1978 | Japan | 355/4 |
| 56-60965 | 5/1980 | Japan | 355/4 |
| 56-19057 | 2/1981 | Japan | 430/44 |

*Primary Examiner*—Arthur T. Grimley
*Assistant Examiner*—J. Pendegrass
*Attorney, Agent, or Firm*—Guy W. Shoup

[57] ABSTRACT

A dual-color electrophotographic copier includes a first photosensitive drum having a first layer comprised of a photoconductive material sensitive to light of a first selected color and a second layer formed on the first layer from a photoconductive material sensitive to light of a second selected color and a second photosensitive drum having a third layer comprised of a photoconductive material sensitive at least to the first selected color. A light image from the same original may be applied to the first and second drums simultaneously to form electrostatic latent images on the first and second drums. These images may be developed by differently colored toner and the toner images may be transferred to the same transfer paper superposingly to obtain a dual-color copy image.

8 Claims, 6 Drawing Figures

| MODE \ DRUM | | DRUM USED | |
|---|---|---|---|
| | | FIRST DRUM | SECOND DRUM |
| BASIC MODE | ALL BLACK MODE | NOT USED |  |
| | NO RED MODE | NOT USED |  |
| | ALL RED MODE |  | NOT USED |
| | NO BLACK MODE |  | NOT USED |
| | RED & BLACK MODE | COMBINATION OF NO RED AND NO BLACK MODES | |

DUAL-COLOR COPIER

BACKGROUND OF THE INVENTION

1. Field of the Invention

This invention relates to a copier capable of producing an image having two different colors, and particularly to a dual-color electrophotographic copier having an increased number of copy modes.

2. Description of the Prior Art

A copier capable of producing a copy image in an analog format as well as in a digital format is well known in the art. In the analog copy mode, an original to be copied is directly exposed to an imaging surface, such as the surface of a photosensitive member, through an optical system, which generally includes lenses and mirrors, thereby forming an electrostatic latent image on the imaging surface. On the other hand, in the digital copy mode, use is made of a recording head disposed opposite to the imaging surface and including a plurality of pixel forming elements arranged in the form of an array and the pixel forming elements are activated selectively in accordance with an image signal supplied. Thus, there is formed a charge pattern on the imaging surface, which constitutes an electrostatic latent image. Such a copier may be operated in a composite mode, which is a combination of the analog and digital copy modes. In this case, there may be obtained a copy image which is a combination of analog and digital information.

Another prior art copier, which appears to be relevant, is a dual-mode electrophotographic copier which uses a raster scanning mechanism in a dual-mode to carry out image synthesization as disclosed in the Japanese Patent Post-examination Publication, No. 55-47392. However, in this case also, a duplex image is formed on a single photosensitive drum and the manner of forming a variety of copy images is limited.

SUMMARY OF THE INVENTION

It is therefore a primary object of the present invention to provide a copier having an increased number of copy modes.

Another object of the present invention is to provide a copier capable of producing a variety of different copy images selectively.

A further object of the present invention is to provide a dual-color electrophotographic copier capable of producing images different in color selectively.

A still further object of the present invention is to provide a dual-color electrophotographic copier which is convenient to use, reliable in operation and compact in size.

Other objects, advantages and novel features of the present invention will become apparent from the following detailed description of the invention when considered in conjunction with the accompanying drawings.

DESCRIPTION OF THE PREFERRED EMBODIMENTS

Figure 1:
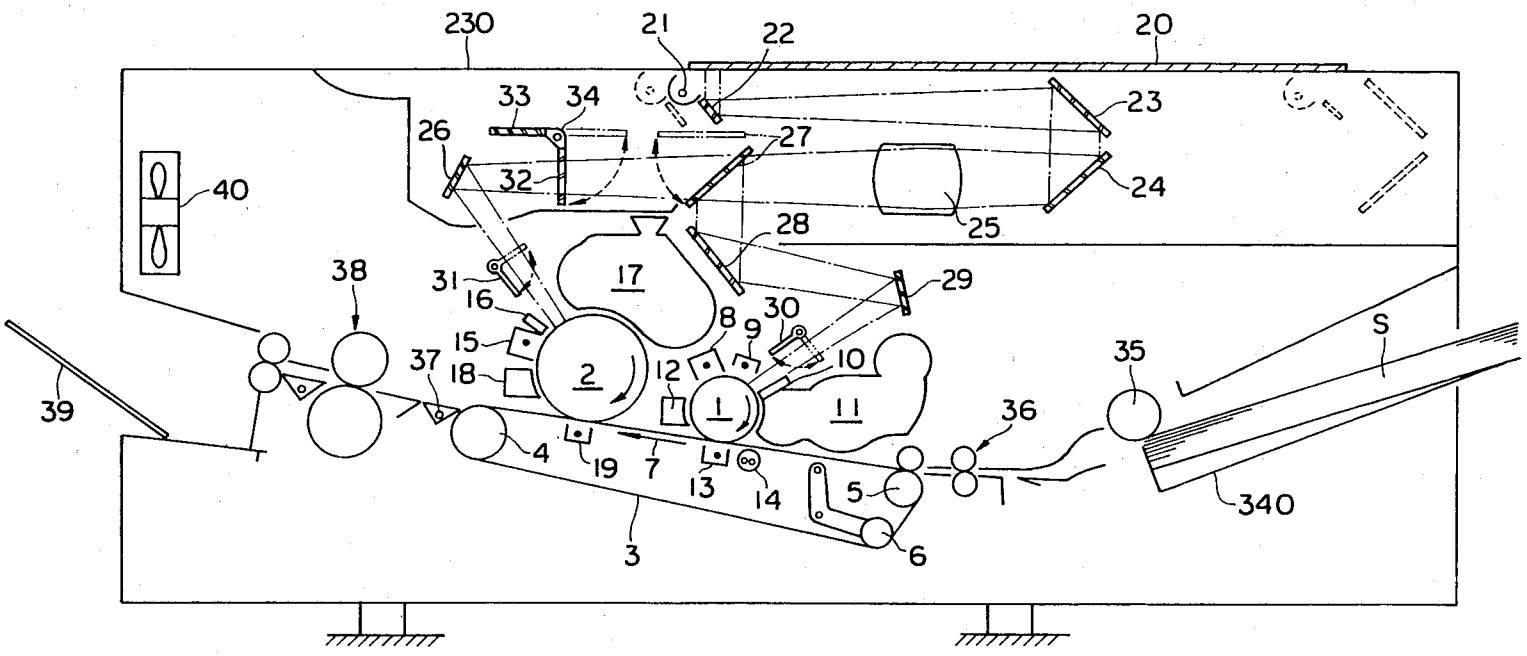
FIG. 1 is a schematic illustration showing the overall structure of a dual-color electrophotographic copier constructed in accordance with one embodiment of the present invention.

Referring now to FIG. 1, there is shown a dual-color electrophotographic copier embodying the present invention. As shown, the dual-color copier includes a first photosensitive drum 1 which is rotatably supported by a housing of the copier and driven to rotate in the direction indicated by the arrow at constant speed. On the peripheral surface of the first drum 1 is provided a pair of photoconductive layers with one overlying the other. These photoconductive layers have different photoconductive properties. For example, the top photoconductive layer is comprised of a photoconductive material which is sensitive to a first selected color, for example red in the present case, and the bottom photoconductive layer is comprised of a photoconductive material which is not sensitive to the first selected color but sensitive to a second selected color, such as blue, which is complementary to the first selected color.

The present copier also includes a second photosensitive drum 2 around the peripheral surface of which is provided a photoconductive layer comprised of a photoconductive material which is sensitive at least to the first selected color, or red in the present example. The photoconductive layer of the drum 2 is the one which is widely used in typical electrophotographic copiers for producing black and white images. These first and second photosensitive drums 1 and 2 are disposed as spaced apart from each other over a predetermined distance with their rotating axes extending in parallel as shown. Also provided is an endless, image transfer belt 3 which extends around support rollers 4, 5 and 6 and is driven to travel in the direction indicated by the arrow 7. The outer surface of the transfer belt 3 is in rolling contact with each of the first and second photosensitive drums 1 and 2.

Around the first photosensitive drum 1 and along the direction of rotation thereof is disposed a primary charger 8, secondary charger 9, first recording head 10, developing unit 11 for developing a latent image with toner of first selected color, or red in the present embodiment, transfer belt 3 and cleaning unit 12. An image exposure position for applying a light image from an original to the first photosensitive drum 1 is defined between the secondary charger 9 and the first recording head 10. A transfer corona unit 13 is so disposed to apply corona ions to the rear or inner side surface of the transfer belt 3 at a location where the drum 1 is in rolling contact with the belt 3. In addition, upstream of the corona transfer unit 13 with respect to the travelling direction of the belt 3 is disposed a pre-transfer exposure lamp 14 for removing charge from the belt 3 by irradiation.

Similarly, around the second photosensitive drum 2 is disposed a charger 15, a second recording head 16, developing unit 17 for developing a latent image with toner of third selected color, or black in the present embodiment, transfer belt 3 and cleaning unit 18 along the direction of rotation of the drum 2. Between the second recording head 16 and the developing unit 17 is defined an image exposure position for leading a light image from an original to the second photosensitive drum 2. Also provided is a corona transfer unit 19 for applying corona ions to the inner surface of the belt 3 at a location where the second photosensitive drum 2 is in rolling contact with the belt 3.

The present copier also includes a contact glass 20 which serves as an original holder for holding thereon an original to be copied. Below the contact glass 20 is disposed an illumination lamp 21 for illuminating an original (not shown) placed on the contact glass 20. A reflecting mirror 22 is provided integrally with the lamp 21 and another pair of reflecting mirrors 23 and 24 are provided below the contact glass 20 to change the direction of the light image reflected from the mirror 22. The lamp 21 and the mirrors 22, 23 and 24 move along the contact glass 20 to carry out slit scanning for an original placed on the contact glass 20. Also provided is a focusing lens 25 for receiving light reflecting from the mirror 24. From the focusing lens 25, there may be defined two optical paths: one leading to the first photosensitive drum 1 and the other leading to the second photosensitive drum 2. There is also provided a half mirror 27, which may be moved into the optical path between the lens 25 and a mirror 26 as indicated by the solid line and which may be moved out of the optical path as indicated by the two-dotted line. The above-described optical path leading to the first drum 1 from the lens 25 is defined only when the half mirror 27 is positioned in the optical path between the lens 25 and the mirror 26. Thus, when the half mirror 27 is positioned as indicated by the solid line, the light from the lens 25 is partly directed toward the first drum 1 as reflected by mirrors 28 and 29. A pivotally supported shutter 30 is provided along the first optical path leading to the first drum 1 at a location close to the drum 1, and the shutter 30 may be pivotted to a block position where the first optical path is blocked. Similarly, a pivotally supported another shutter 31 is provided along the second optical path leading to the second drum 2 at a location close to the drum 2, and the shutter 31 may be pivotted to a block position where the second optical path is blocked.

Between the half mirror 27 and the mirror 26 is disposed a support shaft 34 on which is supported a first selected color filter 32 (red filter in the present case) and a second selected color filter 33 (blue filter in the present case) at an angular spacing of 90°. Thus, by rotating the shaft 34, the red and blue filters 32 and 33 may be located in the optical path selectively.

A stack of transfer paper S is placed on a supply table 340 and a feed roller 35 is provided at the supply end of the table 340 in contact with the topmost sheet of the stack S. Thus, when the feed roller 35 is intermittently driven to rotate in synchronism with the progress of copying operation, the transfer paper is supplied one by one and then transported by transport rollers 36 onto the transfer belt 3. The transfer paper is thus transported as riding on the belt 3, during which the transfer paper comes into contact with the drums 1 and 2 one after another whereby a toner image may be transferred from the drum to the transfer paper. A separating pawl 37 is disposed at the end of the forward travel of the transfer belt 3, so that the transfer paper may be separated from the transfer belt 3 and passed toward an image fixing unit 38 where the toner image is fixed to the transfer paper. The transfer paper is then discharged onto a tray 39. Also provided is a ventilation fan 40 for ventilating the air inside the copier.

Figure 2:
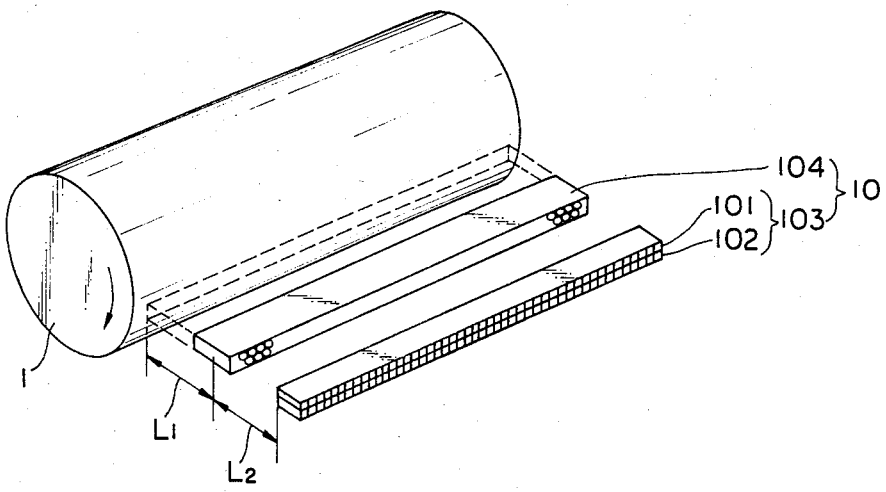
FIGS. 2 and 3 are perspective views showing alternative embodiments of an optical recording head which may be advantageously applied to the structure of FIG. 1.

As described above, the copier is provided with a pair of recording heads, i.e., the first recording head 10 for the first drum 1 and the second recording head 16 for the second drum 2. FIG. 2 illustrates one embodiment of the first recording head 10, which includes a light emitting section 103 comprised of a first array 101 of red light emitting diodes and a second array 102 of blue (or green) light emitting diodes and a focusing section 104 comprised of Selfoc (tradename) lenses. The light emitting diodes of the light emitting section 103 are selectively activated to emit light and a light spot formed by a single light emitting diode defines a pixel on the imaging or peripheral surface of the drum 1. In the illustrated embodiment, the focusing section 104 is disposed with its center located at the center between the drum 1 and the light emitting surface of the light emitting section 103. Thus, the distance $L_1$ between the drum 1 and the center of the focusing section 104 is equal to the distance $L_2$ between the center of the focusing section 104 and the light emitting section 103.

Figure 3:
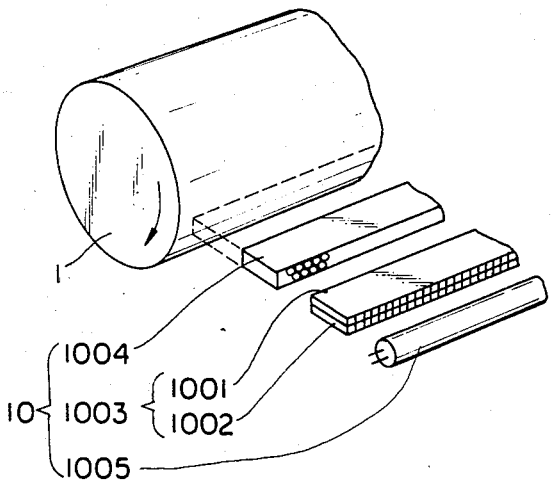

FIG. 3 illustrates another embodiment of the first recording head 10, which includes a liquid crystal section 1,003 comprised of a first array 1,001 of red crystal liquid elements and a second array 1,002 of blue liquid crystal elements, a focusing section 1,004 comprised of Selfoc lenses and a white light lamp 1,005. It is to be noted that when non-colored liquid crystal elements are used, it may be so structured that red and blue (or green) filters may be selectively located as interposed between the drum 1 and the focusing section 1,004. Furthermore, if such filters are provided, use may be made of other optical shutter elements, such as PLZT ceramic elements, instead of the liquid crystal elements.

As a further embodiment, use may be made of a red color light laser, such as a He-Ne gas laser, and a blue or green light laser, such as an Ar gas laser. In this case, use should also be made of an optical system for modulating, focusing and scanning the laser light. If appropriate filters are provided as described above, then use may also be made of a laser, such as He-Cd laser, which emits blue, green or red light.

The second recording head 16 may be constructed by any of the above-described elements, but it is so structured to emit light of single color.

Figure 4:
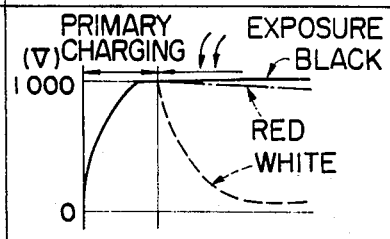
FIG. 4 shows a table showing several basic copy modes of the copier shown in FIG. 1.
Figure 4:
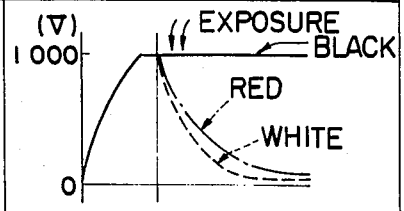
Figure 4:
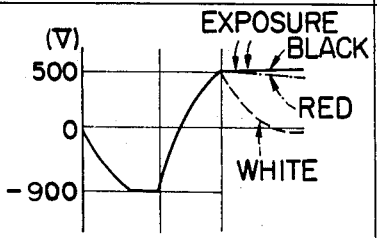
Figure 4:
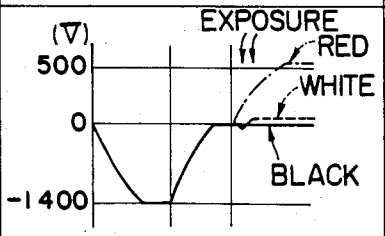

Now, various modes of operation of the present dual-color copier having the above-described structure will be described below with particular reference to FIG. 4.

(1) ALL BLACK MODE

This is the mode of operation in which a copy image is represented by a black and white pattern irrespective of the color of an original image to be copied. In this mode of operation, the first drum 1 is not used and thus the half mirror 27 is located at the position moved away from the optical path between the lens 25 and the mirror 26 as indicated by the phantom line. Besides, the dichroic filter 33 is moved into the optical path leading to the second drum 2 and the second shutter 31 is located at a position away from the optical path.

Thus, when an original having red and black information is placed on the contact glass 20 and scanned, on the second drum 2 is formed an electrostatic latent image corresponding to the black and red information of the original, which is then developed by the black toner supplied by the developing unit 17. And thus the toner image thus formed is all black and it is then transferred to the transfer paper S which is being transported as riding on the transfer belt 3. The final image formed on the transfer paper S is thus represented by a black and white pattern.

(2) NO RED MODE

This is the mode in which a copy image is formed by a black and white pattern corresponding to an original image with leaving red information out. This mode is basically the same as the above-described ALL BLACK MODE (1) excepting that the red filter 32 is placed in the optical path as indicated by the solid line in FIG. 1. Thus, if an original having black and red information is placed on the contact glass 20, an electrostatic latent image corresponding to the black portion of the original is formed on the second drum 2 so that there can be obtained a copy image of black and white pattern with the red information of the original left out.

(3) ALL RED MODE

This is the mode of operation for producing a copy image represented in red irrespective of the color of an original to be copied. In this mode, only the first drum 1 is used and the second drum 2 is not used. Thus, no charging is carried out for the second drum 2. In addition, the half mirror 27 is moved into the optical path as indicated by the solid line in FIG. 1 and the first shutter 30 is moved out of the optical path as also indicated by the solid line.

As the first drum 1 is driven to rotate, its peripheral surface is first charged to −900 V. by the primary charger 8 and then to +500 V. by the secondary charger 9. For example, if an original having black and red information is placed on the contact glass 20, on the first drum 1 is formed an electrostatic latent image corresponding to the black and red information of the original, which is then developed by red toner. This red toner image is then transferred to transfer paper and fixed thereto to obtain a red copy image.

(4) NO BLACK MODE

This is the mode for producing a copy image of red and white pattern with black information of original left out. This mode is basically the same as the above-described ALL RED MODE (3) excepting the method of charging. For example, in this mode, the peripheral surface of the first drum 1 is first charged to −1,400 V. by the primary charger 8 and then to 0 V. by the secondary charger 9. Thus, if an original having black and red information is placed on the contact glass 20, on the first drum 1 is formed an electrostatic latent image corresponding to the red information of the original, which is then developed by red toner. The resulting red toner image is then transferred to transfer paper and fixed thereto to produce a red copy image with the red information of the original left out.

(5) RED & BLACK MODE

This is the mode in which a copy image represented in red as well as in black is reproduced from an original having red and black information. In effect, this is the mode which is a combination of the NO RED and NO BLACK modes (2) and (4) described above. In other words, both of the first and second drums 1 and 2 are used. A red toner image corresponding to the red portion of an original to be copied is formed on the first drum 1 and a black toner image corresponding to the black portion of the original is formed on the second drum 2. And, these red and black toner images are transferred onto the transfer paper S transported as riding on the belt 3 one after another so that a copy image having red and black information corresponding to the red and black pattern of the original can be obtained.

(6) ALL RED PRINT MODE

This is the mode for recording information on the first drum 1 using the first recording head 10. In this mode, only the first drum 1 is used and the second drum 2 is not used. Further, no original is placed on the contact glass 20 and the illumination lamp 21 and the associated optical elements are kept off. The peripheral surface of the first drum 1 may be charged as in the manner described with respect to the above-mentioned NO BLACK MODE (4). After charging, the peripheral surface of the first drum 1 is irradiated by red light emitted from the first recording head 10 in accordance with an image signal thereby forming an electrostatic latent image, which is then developed by red toner. And, the resulting red toner image is transferred to transfer paper and fixed thereto thereby obtaining an all red print.

(7) ALL BLACK PRINT MODE

This is the mode for producing a print represented all in black. In this mode, only the second drum 2 is used and the first drum 1 is not used. No original is placed on the contact glass 20 and the illumination lamp 21 and the associated optical elements are kept off. The peripheral surface of the second drum 2 may be charged as in the manner described with respect to the above-mentioned ALL BLACK MODE (1). After charging, the peripheral surface of the second drum 2 is irradiated by light emitted from the second recording head 16 in accordance with an image signal thereby forming an electrostatic latent image, which is then developed by black toner. And, the resulting black toner image is transferred to transfer paper and fixed thereto thereby obtaining an all black print.

(8) RED & BLACK PRINT MODE

This is the mode for producing a print which is represented partly in red and partly in black. This, in effect, is a combination of the above-described ALL RED PRINT MODE (6) and ALL BLACK PRINT MODE (7). That is, the illumination lamp 21 and the associated optical elements are not used, and the first and second recording heads 10 and 16 are operated in accordance with respective image signals to emit light so that latent images are formed on the first and second drums 1 and 2. Then, the latent image on the first drum 1 is developed by red toner with the latent image on the second drum 2 developed by black toner, and the developed red and black toner images are transferred to transfer paper S on the belt 3 one after another so that a print represented partly in red and partly in black is obtained.

(9) PARTIALLY ERASED RED & BLACK MODE

This is a modification of the above-described RED & BLACK MODE (5), and, in this mode, erasure of part of a red or black image is selectively carried out. Thus, this mode is basically the same as the RED & BLACK MODE (5) described above excepting the addition of the following operation. That is, if it is desired to erase part of a black image, then the second recording head 16 is activated in synchronism with the rotation of the second drum 2 to have the electrostatic latent image formed thereon partly erased. Similarly, if it is desired to erase part of a red image, then the first recording head 10 is activated to erase the latent image formed on the first drum 1 partly.

(10) PARTIALLY ERASED ALL BLACK MODE

This is a modification of the above-described ALL BLACK MODE (1) for erasing part of a black image selectively. This mode is thus basically the same as the before-mentioned ALL BLACK MODE (1). In this mode, however, the second recording head 16 is selectively activated to erase part of the electrostatic latent image formed on the second drum 2.

(11) PARTIALLY ERASED NO RED MODE

This is a modification of the above-described NO RED MODE (2) in which part of a black image with the red portion of an original left out is selectively erased. In operation, this is similar to the PARTIALLY ERASED ALL BLACK MODE (10) described above.

(12) PARTIALLY ERASED NO BLACK MODE

This is a modification of the above-described NO BLACK MODE (4) in which part of a red image with the black portion of an original left out is selectively erased. Thus, operationally, this is basically the same as the NO BLACK MODE (4) described above. In this mode, however, blue light is selectively emitted from the first recording head 10 to have the electrostatic latent image formed on the first drum 1 partially erased.

(13) PARTIALLY ERASED ALL RED MODE

This is a modification of the above-described ALL RED MODE (3) in which part of a red image is selectively erased. Thus, this is basically the same as the ALL RED MODE (3) excepting that, in the present mode, the first recording head 10 is selectively activated to emit blue light thereby erasing part of the latent image on the first drum 1.

(14) PARTIALLY PRINTED RED & BLACK MODE

This is a modification of the above-described RED & BLACK MODE (5) for producing a dual-color copy image represented both in red and black corresponding to the red and black pattern of an original to be copied with print in red, black or both red and black added to the copy image. Thus, this is basically the same as the RED & BLACK MODE (5) described above. However, in the present mode, the first and second shutters 30 and 31 are operated such that no exposure light from an original reaches those portions of the peripheral surfaces of the first and second drums 1 and 2 which correspond to the leading, trailing and side portions of the original. And, the first and second recording heads 10 and 16 are selectively activated in accordance with desired image signals to record additional images in the non-exposed portions.

(15) RED PRINT ADDED ALL BLACK MODE

This is a modification of the above-described ALL BLACK MODE (1) in which a copy image is produced in a black and white pattern irrespective of the color of an original to be copied with the addition of a red print. Thus, in this mode, in addition to the operation of the ALL BLACK MODE (1), the first recording head 10 is selectively activated to emit red light which is used to form an electrostatic latent image on the first drum 1, which is then developed to form a red toner image. This red toner image is transferred to the transfer paper S which also receives a black toner image from the second drum 2 so that there is obtained a copy image of black and white pattern with a red print added.

(16) RED PRINT ADDED NO RED MODE

This is a modification of the above-described NO RED MODE (2) in which a copy image of black and white pattern with the red information of an original left out is produced with the addition of a red print. Thus, in this mode, in addition to the operation of the NO RED MODE (2), the first shutter 30 is pivotted to the block position to block the optical path leading to the first drum 1, and the first recording head 10 is selectively activated in accordance with an image signal to emit red light which is used to form an electrostatic latent image on the first drum 1, which is then developed to form a red toner image. This red toner image is then transferred to the transfer paper S on the belt 3, which also receives a black toner image with the red information of the original left out from the second drum 2.

(17) BLACK PRINT ADDED NO BLACK MODE

This is the mode for producing a copy image of white and red pattern with the black information of an original left out and with the addition of a black print. Thus, in this mode, in addition to the operation of the NO BLACK MODE (4), the second shutter 31 is operated to block the optical path leading to the second drum 2 and the second recording head 16 is selectively activated in accordance with an image signal to form an electrostatic latent image on the second drum 2. This latent image is then developed to be converted into a black toner image, which is transferred to the transfer paper S on which a red toner image with the black information of the original left out has already been transferred from the first drum 1.

(18) BLACK PRINT ADDED ALL RED MODE

This is the mode for adding a black print into a copy image which is represented in all red irrespective of the color of an original to be copied. In this mode, in addition to the operation of the ALL RED MODE (3), the operation of the second drum 2 as described above with respect to the mode (17) is added.

It is to be noted that in selective activation of the recording head, the first recording head 10 is activated to emit light when information is to be recorded on the first drum 1 (positive light emitting method); on the other hand, the second recording head 16 is deactivated to emit no light when information is to be recorded on the second drum 2 (negative light emitting method).

Figure 5:
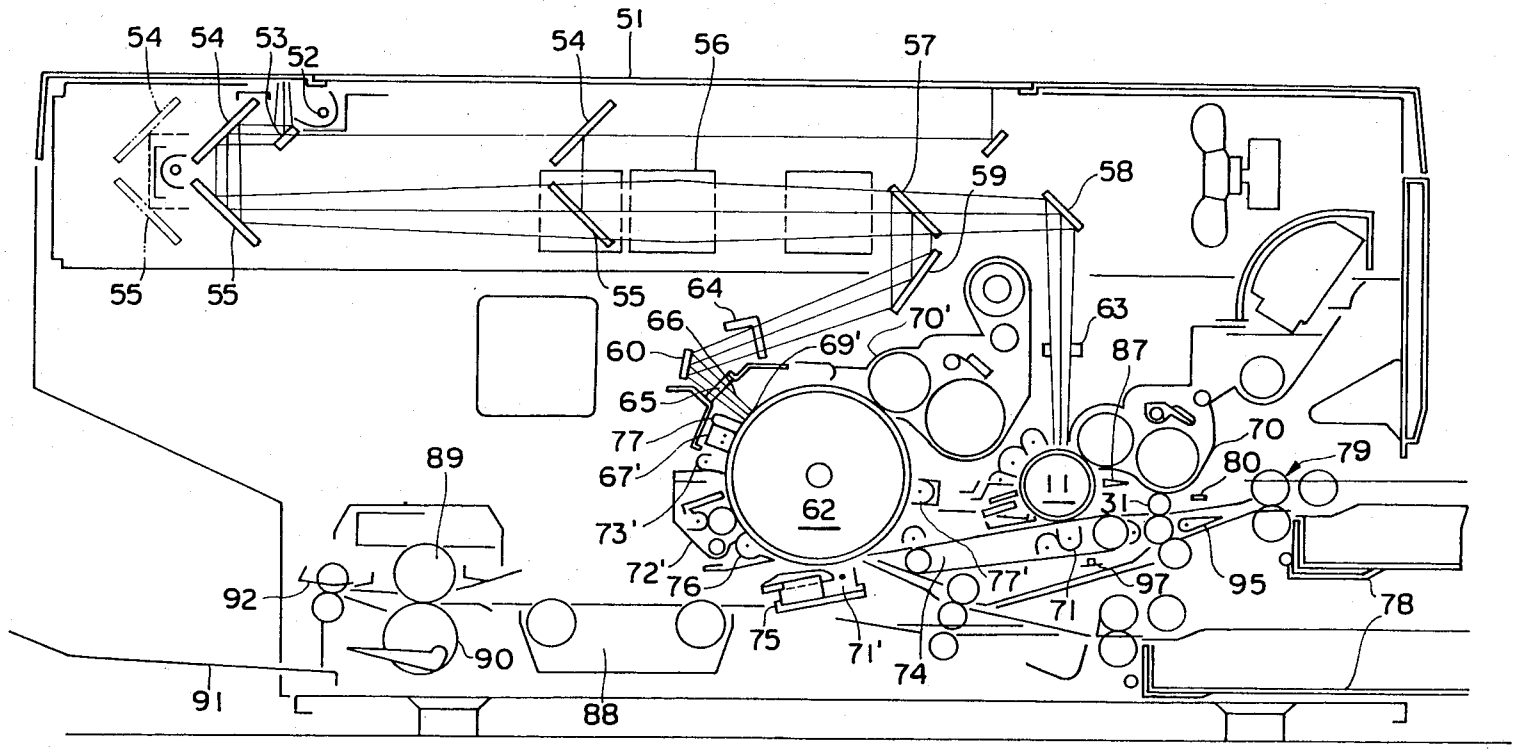
FIG. 5 is a schematic illustration showing the overall structure of a dual-color electrophotographic copier constructed in accordance with another embodiment of the present invention.

FIG. 5 shows a dual-color copier constructed in accordance with another embodiment of the present invention. As shown, an original (not shown) placed on an original holder 51 is illuminated by an illumination lamp 52 and a light image from the original is reflected by first, second and third mirrors 53, 54 and 55 and reaches a half mirror 57 as passing through a focusing lens 56. This light is then split at the half mirror 57 into first light leading to a first photosensitive drum 61 and second light leading to a second photosensitive drum 62. The first light from the half mirror 57 reflected by a fourth mirror 58 to impinge upon the first photosensitive drum 61, comprised, for example, of a photoconductive material which is sensitive to red light. On the other hand, the second light from the half mirror 57 is reflected by fifth and sixth mirrors 59 and 60 to impinge upon the second photosensitive drum 62. Preferably, various mirrors are so arranged that the first and second optical paths are of the same length. In the following description of the present embodiment, red and black are selected, but the selection of color should not be limited only thereto.

Figure 6:
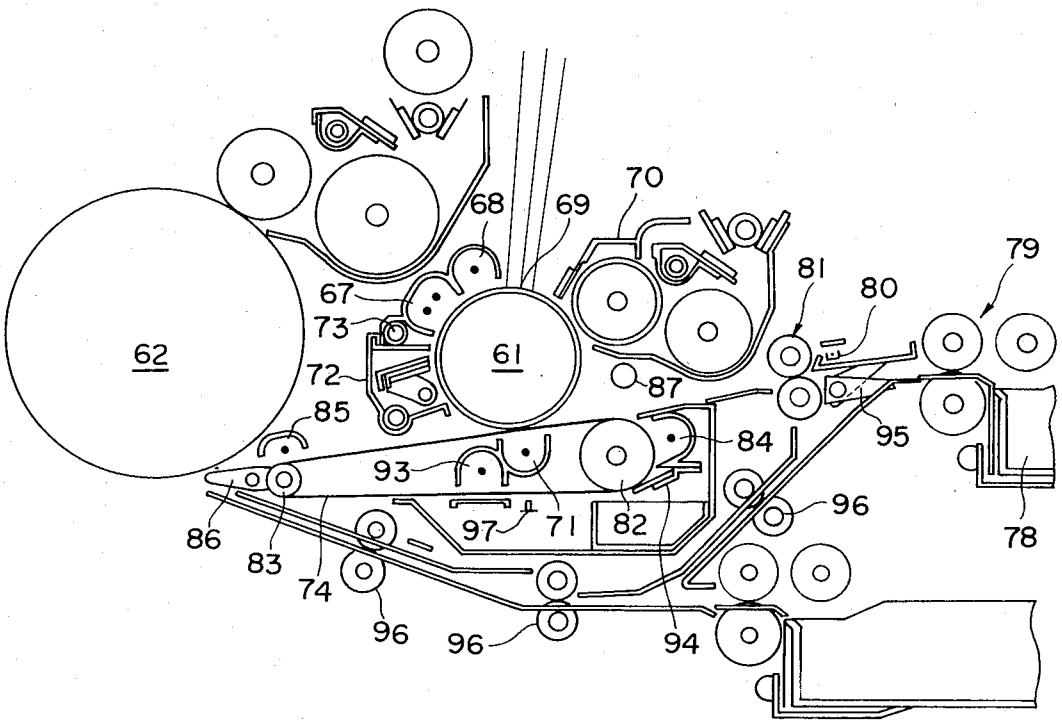
FIG. 6 is an enlarged view showing in detail part of the structure illustrated in FIG. 5.

As shown, an iris 63 is provided in the first optical path from the mirror 58 to the first drum 61; on the other hand, in the second optical path from the mirror 59 to the second drum 62 are provided a filter 64, a focus correction glass 65 and an iris 66. As shown in FIG. 6, around the first photosensitive drum 61 is disposed a primary charger 67, secondary charger 68, exposure position 69, developing unit 70, corona transfer unit 71, cleaning unit 72 and charge-removing lamp 73 in the order mentioned along the direction of rotation of the drum 61. Utilizing the difference in spectral sensitivity of the drum 61, an electrostatic latent image corresponding to the red information of an original to be copied is formed on the drum 61, which is then developed by the developing unit 70 to be converted into a red toner image, which, in turn, is transferred to transfer paper transported as riding on a transport belt 74. After transfer, the drum 61 is cleaned by the cleaning unit 72 to remove any residual toner and then the remaining charge is also removed due to irradiation by the lamp 73 thereby preparing the drum 61 ready for the next operation.

On the other hand, as shown in FIG. 5, around the second photosensitive drum 62 is disposed a primary charger 67', exposure position 69', developing unit 70' which uses toner having the color, e.g., black, different from the color of the toner used in the developing unit 70, corona transfer unit 71', paper separating corona unit 75, pre-cleaning corona unit 76, cleaning unit 72', and charge-removing irradiation unit 73' in the order mentioned along the direction of rotation of the second drum 62. Thus, on the drum 62 is formed an electrostatic latent image corresponding to the black information of an original to be copied, which is developed by the developing unit 70' to be converted into a black toner image, which, in turn, is transferred to transfer paper transported as riding on the transport belt 74.

For the second drum 62, the charge-removing irradiation unit 73' comprised of green light emitting diodes is disposed between the primary charger 67' and the exposure position 69' so that the charge on the unnecessary portion of the drum 62 is removed prior to the image exposure step. It is to be noted that these light emitting diodes are arranged in the form of array across the width of the drum 62.

The transfer paper is stored in a cassette 78 and supplied one by one by a feed roller 79. As the transfer paper is supplied, its leading edge is detected by a sensor 80 and the feed roller 79 comes to a halt after having rotated for a predetermined time period which is necessary for the transfer paper to reach a registration roller 81 (see FIG. 6). The transport belt 74 extended between a driving roller 82 and a follower roller 83 is comprised of a dielectric material. Also provided is a detector 97 for detecting a seam of the transport belt 74. It is so structured that the transport belt 74 comes to a halt immediately after detecting the passing of the seam by the detector 97 and waits for the next operation. The transport belt 74 is operated in synchronism with the operation of the first drum 61. Of course, the detector 97 may be discarded if the transport belt 74 is a seamless belt.

When the transfer paper reaches the transport belt 74, it is electrostatically attracted to the transport belt 74 due to a function of a precharger 84 so that the transfer paper moves as riding on the transport belt 74 without slippage therebetween. As the transfer paper moves past the corona transfer unit 71, the red toner image on the first drum 61 is transferred to the transfer paper. When the transfer paper reaches the extreme end of travel, it is separated from the belt 74 due to a cooperation among the radius of the roller 83, a corona unit 85 for removing the charge and a separating pawl 86. In the illustrated embodiment, the separating pawl 86 extends over some length horizontally thereby serving as a guide for transporting the transfer paper to the second drum 62. As the transfer paper moves past the corona transfer unit 71', a black toner image on the second drum 62 is transferred to the transfer paper as superposed on the red toner image which has been transferred from the first drum 61. Upstream of the transfer position for each of the drums 61 and 62 is disposed a pre-transfer charge-removing unit (a lamp or a corona unit) 87 and 77', which serves to reduce the amount of charge of developed toner image thereby allowing to increase the image transfer efficiency.

After transfer, the drums 61 and 62 are cleaned to remove any residual toner and the residual charge is also removed, if necessary, thereby preparing the drums 61 and 62 for the next cycle of operation. On the other hand, the transfer paper having received a toner image from the second drum 62 is separated from the second drum 62 by means of a paper separating corona unit 75 and then transported toward an image fixing roller 90 as riding on a transport belt 88. While the transfer paper moves past the fixing roller 90 as pressed between the fixing roller 90 and a pressure roller 89, the toner image becomes fixed to the transfer paper which is then transported to an exit tray 91. Also provided is a charge-removing roller 92 which comes into contact with the transfer paper to remove the charge thereon.

On the other hand, after separation of the transfer paper, the transport belt 74 comes to a position where a charge-removing corona unit 93 is located and thus the charge may be removed from the transport belt 74. Furthermore, there is provided a cleaning blade 94 with its forward end in sliding contact with the outer surface of the belt 74 so that any residual toner may be removed from the belt 74. The transport belt 74 comes to a halt in association with the rotation of the first drum 61.

It is preferable to so structure that the first drum 61 located upstream with respect to the direction of movement of the transfer paper as compared with the second drum 62 is used to form an image of lighter color between the two color images and the second drum 62 is used to form an image of darker color. Thus, in the present case where red and black are selected, preferably, the first drum 61 is used to form a red image and the second drum 62 is used to form a black image. Stated more in detail in this respect, any residual toner on each of the first and second drums 61 and 62 can be collected by the respective cleaning units 72 and 72' for reuse. However, if part of the first toner on the transfer paper comes to adhere to the second drum 62, it may be collected as mixed with the second toner. Even under such circumstances, as long as the second toner for the second drum 62 is darker in color as compared with the first toner, there will be presented no practical problem in reusing the collected toner.

It should also be noted that the transport belt 74 extends only below the first drum 61 and does not extend below the second drum 62. Thus, the first toner used for the first drum 61, which somehow adheres to the transport belt 74, is prevented from adhering to the second drum 62.

In the above-described structure, a light image of dual color is exposed to the first and second drums 61 and 62 simultaneously and the toner images formed on the respective drums 61 and 62 are transferred to the same transfer paper, and, thus, timing of transferring the toner image to the transfer paper must be shifted in time corresponding to the distance between the two drums 61 and 62. Accordingly, the circumferential distance between the exposure position and the transfer position of the first drum 61 must be set shorter than the circumferential distance between the exposure position and the transfer position of the second drum 62 by the distance between the transfer positions of both of the drums 61 and 62.

In accordance with the present invention, since two differently colored images can be formed on the two different drums separately, it is not by all means necessary to form an image extending the full length of the transfer paper; instead, the image can be formed partially and transferred sequentially, which allows to use a drum of smaller diameter as compared with the prior art drum which were used to form two differently colored images thereon. Preferably, the first drum 61 has a diameter approximately ranging between 25 mm and 60 mm. As described previously, the first drum 61 has a composite imaging layer formed around its peripheral surface and the composite imaging layer includes a pair of photoconductive layers which are provided one on top of the other and which are different in spectral sensitivity. On the other hand, the second drum 62 used for forming a black toner image may include an ordinary photoconductive material such as Se.

If the dual-color copier is so structured that only the first drum has a composite imaging layer and it may be selectively operated in a single color copy mode using only the second drum 62 or in a dual-color copy mode using both of the first and second drums 61 and 62, it is sometimes desired to slow down the travelling speed of the transporting system in the dual-color mode as compared with the single color mode. In such a case, if the transfer belt 74 is in rolling contact with both of the drums 61 and 62, the travelling speed of the transfer belt, together with other associated elements such as cleaning and charge-removing units, must be suitably adjusted. The service life of the belt and blade could also be impaired. However, in accordance with the present invention, since the transfer belt 74 is only in rolling contact with the first drum 61, during the single color copy mode, the first drum 61 and the transfer belt 74 may be held inoperative.

In the case where the single color copy mode is to be carried out by holding the first drum 61 and the transfer belt 74 inoperative and by using only the second drum 62, a passage switching pawl 95 is pivotted to switch passages thereby allowing the transfer paper fed by the feed roller 79 to be transported toward a transport roller 96. Thus, the transfer paper may be supplied to the second drum 62 through a bypass passage without being brought into contact with the first drum 61. For example, in dual-color, all red, no black and no red modes, the transfer paper is transported to the transfer belt 74 from the feed roller 79; whereas, in all black and no red modes, the transfer paper is directly transported to the second drum 62 from the feed roller 79 by bypassing the first drum 61.

While the above provides a full and complete disclosure of the preferred embodiments of the present invention, various modifications, alternate constructions and equivalents may be employed without departing from the true spirit and scope of the invention. Therefore, the above description and illustration should not be constructed as limiting the scope of the invention, which is defined by the appended claims.

What is claimed is:

1. An imaging apparatus comprising:

an original holder for holding thereon an original;

first image forming means including a first photoconductive layer having sensitivity to light of a first selected color and second photoconductive layer having sensitivity to light of a second selected color which is different from said first selected color, said first imaging forming means including a first drum having a first peripheral surface on which said first and second photoconductive layers are formed overlying one on top of the other;

second image forming means including a third photoconductive layer having sensitivity at least to light of a first selected color, said second image forming means including a second drum having a second peripheral surface on which said third photoconductive layer is formed;

a first optical system for leading a light image from said original to said first imaging forming means thereby forming a first electrostatic latent image on said first image forming means;

a second optical system for leading said light image from said original to said second image forming means thereby forming a second electrostatic latent image on said second image forming means;

first developing means for developing said first latent image by applying toner of said first selected color;

second developing means for developing said first latent image by applying toner of said second selected color;

transporting means for transporting a transfer medium along a predetermined path along which said first and second image forming means are disposed;

first transferring means for transferring a toner image formed by said first developing means to said transfer medium; and second transferring means for transferring a toner image formed by said second developing means to said transfer medium; and such that said transporting means includes a transfer belt which is in rolling contact with said first drum but not in rolling contact with said second drum.

2. The apparatus of claim 1 further comprising means for selectively establishing said first optical path.

3. The apparatus of claim 2 wherein said means for selectively establishing includes a half mirror which is pivotally supported to be locatable at a first position for allowing said first optical system to lead said light image to said first image forming means and at a second position for preventing said first optical system to lead said light image to said first image forming means.

4. The apparatus of claim 1 wherein said second optical system includes a filter of said first selected color, which may be selectively moved into or moved out of an optical path of said second optical system.

5. The apparatus of claim 4 wherein said first optical system includes a first shutter which may be selectively moved into or moved out of an optical path of said first optical system and said second optical system includes a second shutter which may be selectively moved into or moved out of said optical path of said second optical system.

6. The apparatus of claim 1 wherein said first drum is disposed upstream of said second drum with respect to the direction of movement of said transfer medium.

7. The apparatus of claim 6 wherein said first drum is smaller in diameter than said second drum.

8. The apparatus of claim 6 wherein said first selected color is lighter than said second selected color.

* * * * *